US005921717A

United States Patent [19]

Dawson

[11] Patent Number: 5,921,717

[45] Date of Patent: Jul. 13, 1999

[54] STRUCTURE HAVING DEFORMABLE FLANGED MEMBER AND METHOD OF FORMING THE SAME

[75] Inventor: Robin Dawson, Milton Keynes, United Kingdom

[73] Assignee: Dawson Construction Plant Limited, United Kingdom

[21] Appl. No.: 08/793,306

[22] PCT Filed: Sep. 15, 1995

[86] PCT No.: PCT/GB95/02193

§ 371 Date: Jun. 30, 1997

§ 102(e) Date: Jun. 30, 1997

[87] PCT Pub. No.: WO96/09442

PCT Pub. Date: Mar. 28, 1996

Related U.S. Application Data

[30] Foreign Application Priority Data

Sep. 19, 1994 [GB] United Kingdom ..... 9418826

[51] Int. Cl.[6] ..... E02D 5/08

[52] U.S. Cl. ..... 405/279

[58] Field of Search ..... 405/14, 279–281, 405/285

[56] References Cited

U.S. PATENT DOCUMENTS 1,855,113 4/1932 Nolte ..... 405/14

FOREIGN PATENT DOCUMENTS 0 072 118 2/1983 European Pat. Off. .
571 029 2/1933 Germany .
593 825 4/1934 Germany .
315 402 2/1930 United Kingdom .

*Primary Examiner*—Tamara Graysay
*Assistant Examiner*—Tara L. Mayo
*Attorney, Agent, or Firm*—Robert D. Schaffer; Rogers & Wells LLP

[57] ABSTRACT

A method of forming a structure comprising at least one locking bar and at least one structural member, at least one flange of the structural member being formed with alternating first and second flange portions. The first flange portions are deformed out of the plane of the flange. The locking bar has arms which between them define a slot configured to receive the flange of the structural member. The method includes deforming one arm of the locking bar into at least some of the gaps between the said first flange portions.

9 Claims, 5 Drawing Sheets

STRUCTURE HAVING DEFORMABLE FLANGED MEMBER AND METHOD OF FORMING THE SAME

BACKGROUND OF THE INVENTION

1. Field of the Invention

This invention relates to a method of forming a piling structure using a locking bar, and to a piling structure formed by this method. The invention has particular application to piling which has a relatively high rigidity, but it is not limited to high rigidity piling.

2. Description of the Related Art

High rigidity piling has, in plan view, the appearance of a series of hollow boxes or sections. This is in contrast to ordinary piling which is in the form of sheets. The hollow boxes or sections are formed of individual steel structural members, for example I-sections, U-sections or angles, which are connected together along adjoining flanges by means of a locking bar. The locking bar includes a pair of opposing recesses for the flanges of adjoining structural members, these recesses narrowing towards the outside. Conventionally, the edges of the flanges of the structural members have lips formed thereon for engagement in the recesses of the locking bar. Such lips are formed during the hot rolling process in which the structural members themselves are formed, but there are difficulties with the lip forming process which tends to significantly increase the costs of producing the structural members.

Another problem with conventional high rigidity piling is that after each structural member is slotted together with the locking bars—in the case of an I-beam a locking bar is fitted on each of the flanges on one side—the member and bars must be welded together in order to create a homogenous profile to the piling and so that the full section modulus is developed. Furthermore, the structural members and locking bars need to be connected together so that they are carried integrally down into the ground during pile driving. The welding process is usually carried out at the production site, rather than the piling site, but it is labour intensive, slow, costly and can also lead to distortion of the structural members due to the high local heat levels used.

The problem of forming lips on the structural members has been solved in DE-C-593825 and EP-B-0072118. According to these patents, portions of the edges of the flanges of the structural members are deformed out of the plane of the remainder of the flange, such portions alternating with portions which are not deformed. Such deformed portions are generally known as "crimps", since the process by which they are usually formed in analogous to crimping. In end view, the edge of the flange has an outwardly tapered shape (in the manner of a "fish tail") and thus the edge can slot longitudinally in to one of the recesses of the locking bar, but cannot be pulled out laterally.

However, even with the crimped structural members, welding to the locking bar must still be done and therefore the second problem mentioned above still remains.

SUMMARY OF THE INVENTION

Accordingly, the present invention provides a method of forming a structure comprising at least one locking bar and at least one structural member, at least one flange of the structural member being formed with alternating first and second flange portions, at least the first flange portions being deformed out of the plane of the flange, and the locking bar having arms which between them define at least one slot configured to receive the flange of the structural member, wherein the method includes the step of deforming at least one arm of the locking bar into at least some of the gaps between the said first flange portions.

The invention also provides a piling structure formed by this method, namely a plurality of structural members interconnected by a plurality of locking bars deformed in the manner described above.

The flange of the structural member can be formed with both first and second flange portions deformed out of the flange plane, in opposite directions. Opposing locking bar arms are alternately deformed into the gaps between first or second flange portions. This double-deforming of the locking bar increases the bending rigidity of the structure.

Preferably, the locking bar arm is fully deformed or "crimped" into the gaps between adjacent deformed portions or "crimps" of the relevant flange. It is preferred for the locking bar arm to be deformed into all the gaps between the crimps of the structural member, for maximum rigidity.

The secondary crimping of the locking bar into the gaps between the crimps of the structural member—e.g. a beam—with the locking bar crimps butting up against the beam crimps, creates an efficient longitudinal shear transfer between the beam and the locking bar, thereby eliminating the need for welding. It is also preferable for the locking bar flange, when being deformed, to be forced onto the face of the beam flange, which will lock the locking bar in position and eliminate relative rotation.

BRIEF DESCRIPTION OF THE DRAWINGS

The invention can be understood in more detail by the following exemplary description of one way of performing the invention. The description refers to the accompanying drawings, wherein.

DETAILED DESCRIPTION OF THE INVENTION

Figure 1:
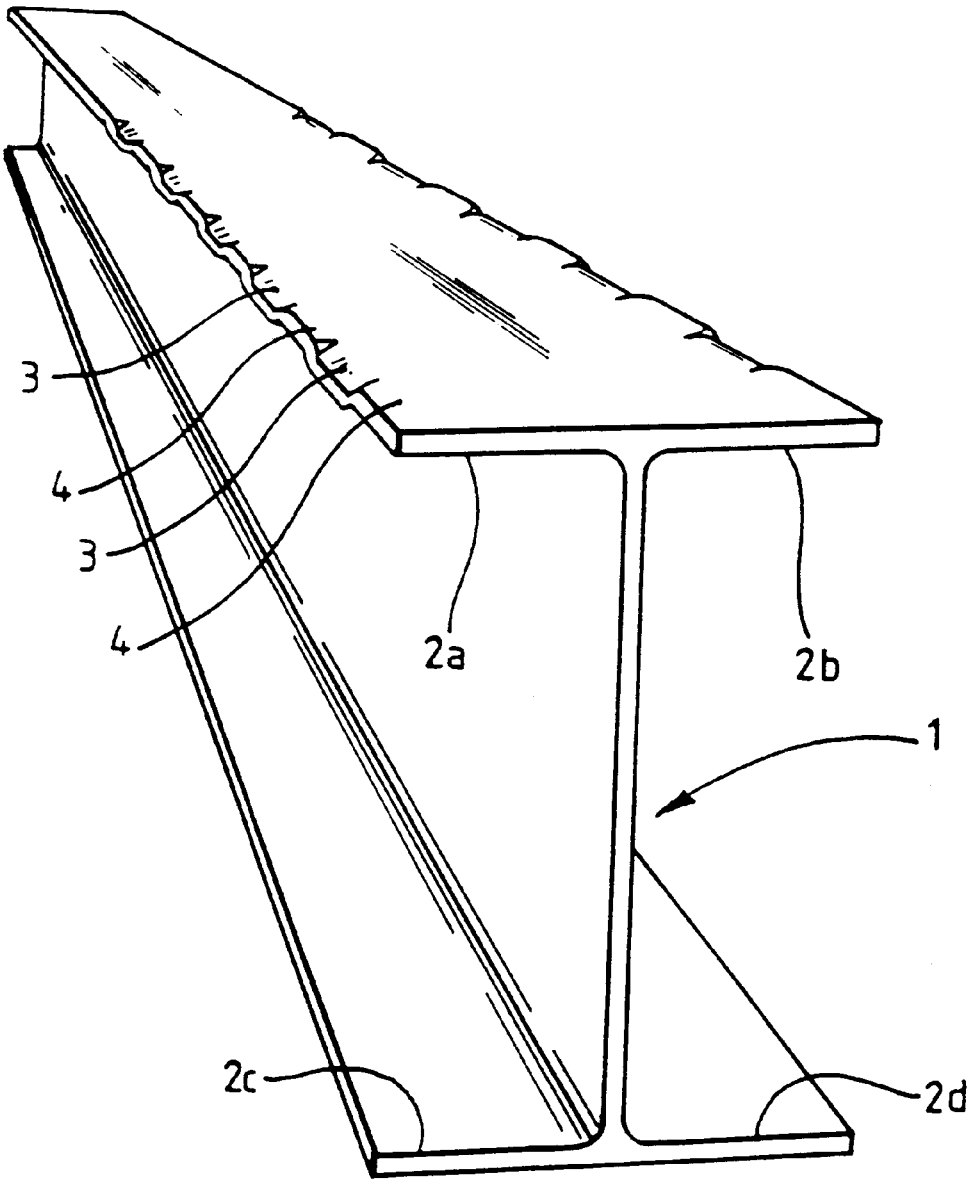
FIG. 1 is a perspective view of a crimped structural member.

FIG. 1 shows an I-section beam 1 having a pair of flanges 2*a* and 2*b* and an opposed pair of flanges 2*c* and 2*d*. The edges of the flanges have portions 3 which are deformed out of the plane of the remainder of the flange, alternating with portions 4 which are not deformed in this way. The deformed portions are referred to herein as "crimps". The crimps are indicated only along part of the length of the flanges 2*a* and 2*b*, but in practice they would generally be present along the whole length of each of these flanges, as well as along the whole length of flanges 2*c* and 2*d* if interlocking is required on all flanges. The angle of crimping, i.e. the angle between the planes of portions 3 and 4, may vary but is generally less than 45°, for example from 15–45°, preferably from 25–40°. The preferred angle in the present embodiment is 35°.

The length of the portions 3 and 4 can vary, but they may be in the range of from 25–100 mm, preferably 75 mm. Allowing for the lengths of the transitional portions between crimped and uncrimped portions, the pitch length of the crimping, i.e. the distance of the centres of adjacent crimped portions, is conveniently from 100–300 mm. The crimps 3 can be formed in a cold process, for example, as is disclosed in EP-B-0072118.

Figure 2:
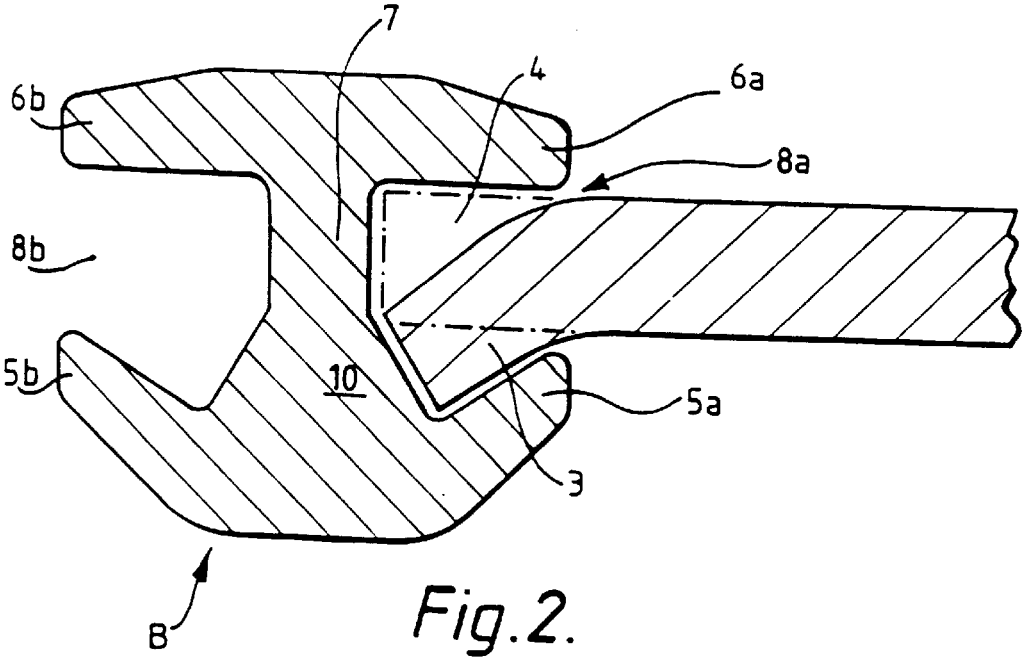
FIG. 2 is a sectional view showing the locking bar and the crimped edge of the structural member, at a point where the locking bar is not crimped.

As in the prior art, the effect of the creation of the crimps is that the edge of each flange forms, in end view, a divergent wedge. This is shown in FIG. 2, with the undeformed portion 4 being shown in dashed lines. The locking bar of FIG. 2 is substantially the same as the locking bar of the prior art, in particular FIG. 3 of EP-B-0072118. Thus, the locking bar B has a cross-section in the general shape of a letter I, comprising a first pair of arms 5*a* and 5*b*, a second pair of arms 6*a* and 6*b* and a cross piece 7 connecting the pairs of arms. At least the arms 5*a*, 5*b* are inwardly inclined, thereby defining a pair of slots or recesses 8*a* and 8*b* whose width decreases to the outside.

While FIG. 2 shows only one flange, it will be understood that the locking bar B would normally be joining two flanged structural members.

It should be understood that, if desired, the locking bar could be formed with only two arms forming a single slot.

The cross piece 7 comprises a pair of surfaces which each faces into a respective one of the slots and the surfaces have first and second portions defining between them an angle which is less than 180°. In other words, the cross piece 7 includes at one end a wedge shaped portion 10 which substantially conforms to the edges of the crimps (as shown in FIG. 2). This formation of the cross piece helps to reduce the amount of water which the piling structure allows to pass from one side to another.

Figure 3:
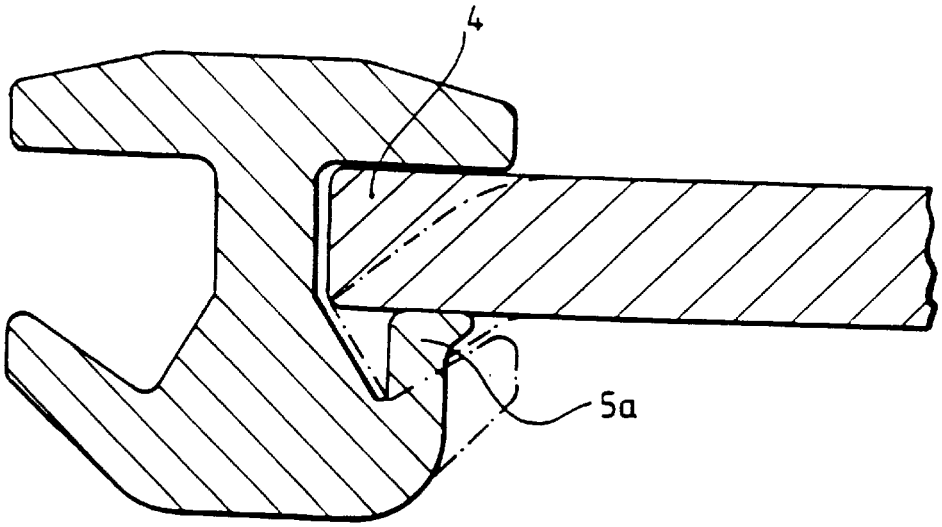
FIG. 3 is a sectional view, similar to that of FIG. 2, but at a point where the locking bar is crimped and the edge of the structural member is not.

As shown in FIG. 3, which is a section through the I-beam and locking bar at a position in which the uncrimped portion 4 of the flange is in the locking bar recess, the arm 5*a* of the locking bar is deformed or crimped into the space between the crimps 3 of the I-beam. Preferably, the arm of the locking bar is deformed along the whole of the length of the uncrimped portion of the I-beam, i.e. along the whole of the gap between the crimps of the beam. This will eliminate the need for any welding. However, in other circumstances the locking bar may only be crimped along part of the gap between the crimps of the beam, in which case a reduced amount of welding, as compared with the conventional piling methods, is necessary.

Figure 4:
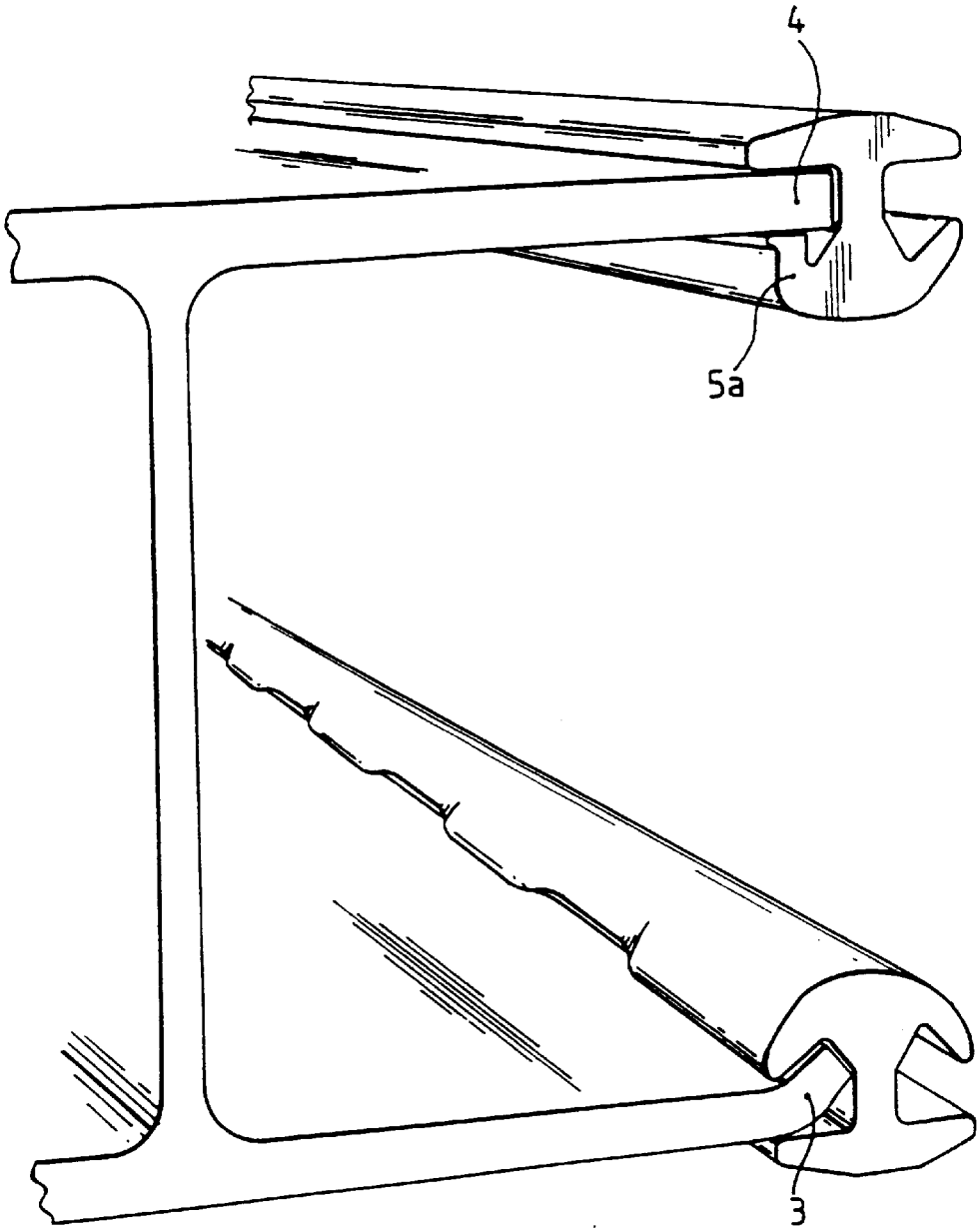
FIG. 4 is a perspective view showing the join between the locking bar and the edge of one structural member.

The deforming of the locking bar into the spaces between the crimps of the I-beam is clearly shown in the perspective view of FIG. 4.

It is also possible for the locking bar instead to be crimped onto the crimps themselves—i.e. arm 6*a* is deformed onto crimp 3 in FIG. 2—although this is less preferred.

For the avoidance of any doubt, it should be emphasized that the invention can be used with different forms of locking bar and different forms of structural members, and it is not limited to high rigidity piling. In particular, the locking bar could be in the form as shown in FIG. 7 of EP-B-0072118 and the structural members could be in the forms shown in FIGS. 4, 4*a*, 5, 6, 9, 10 or 11 of that patent. Moreover, the crimps can be formed on only one, or some or all of the free edge portions of the structural member, according to circumstances, and the crimps may vary in angle along the same flange, or crimps on the same flange can be deformed in opposing directions.

Figure 5:
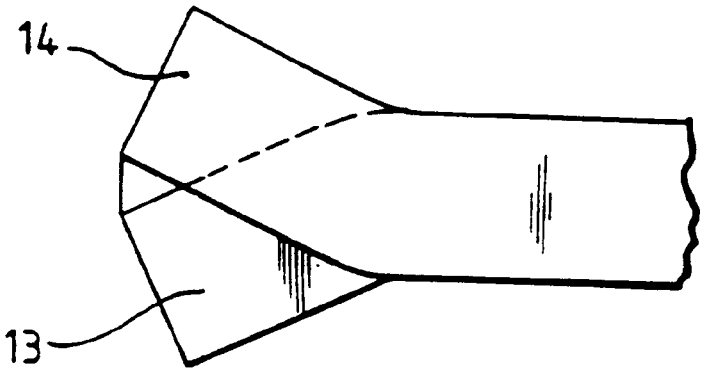
FIG. 5 is a partial end view of a differently crimped structural member.

This last possibility is illustrated in the end view of FIG. 5 which shows the edge 13, 14 of a doubly crimped structural member, i.e. with the flange alternately deformed into two opposing planes each at, say, 25° to the plane of the flange. The arms of the locking bar which define the slot can be alternately deformed or crimped onto the flange in order to join the structural member to the locking bar. It will be understood that each crimp of the arms will be onto those portions of the flange which are crimped away from it.

Figure 6:
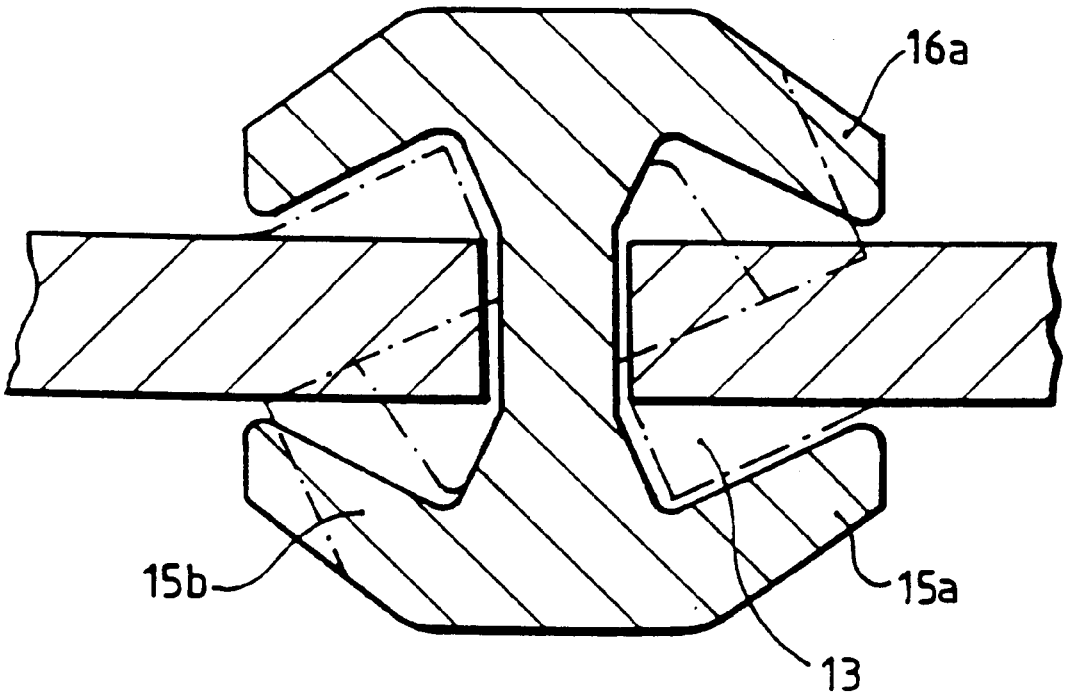
FIG. 6 is a sectional view, similar to that of FIGS. 2 and 3, showing the crimping of the structural member of FIG. 5 and an alternative locking bar.
Figure 7:
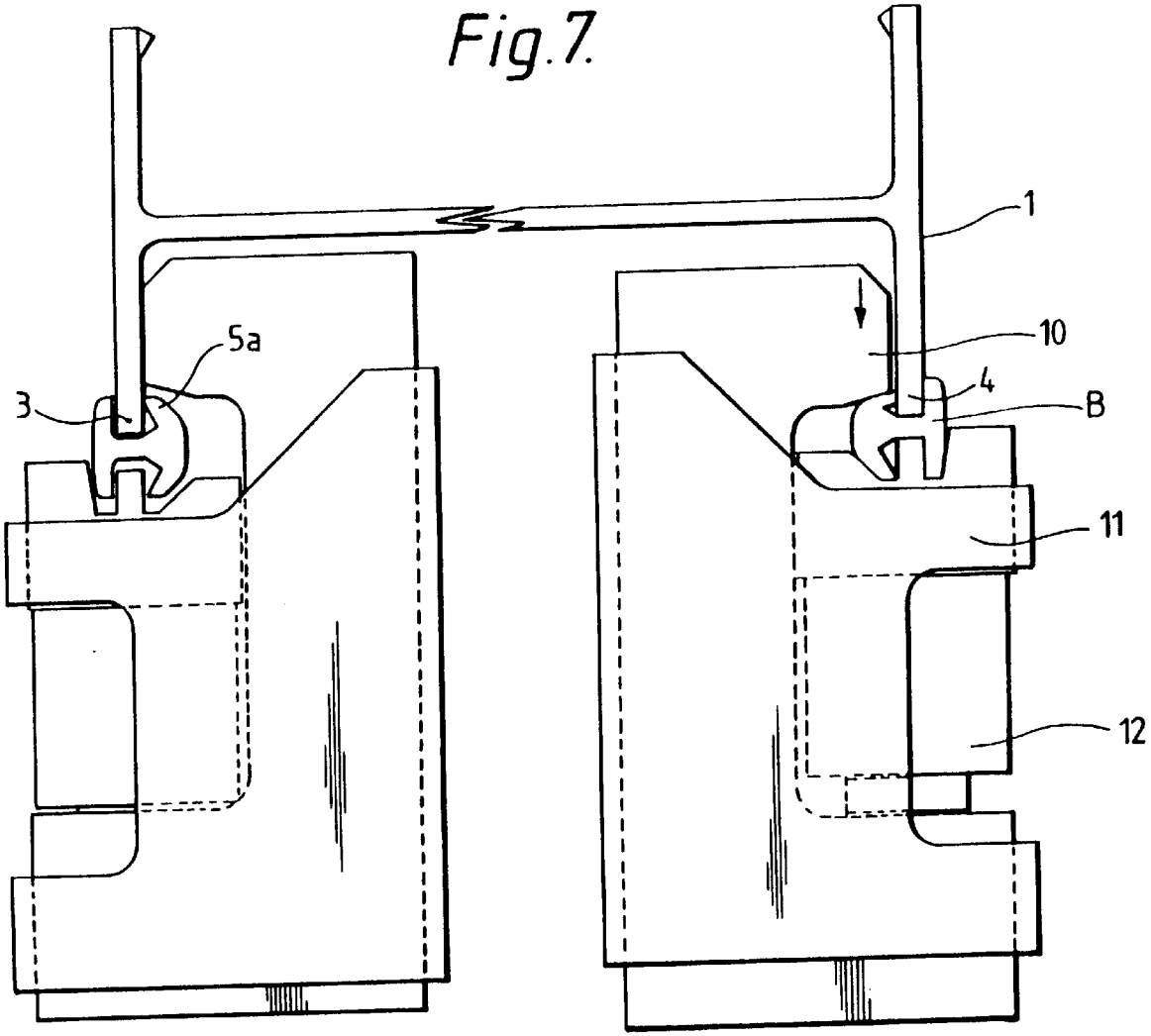
FIG. 7 is a front elevational view of a machine for deforming or crimping the locking bar.

A form of locking bar suitable for use with the structural member of FIG. 5 is shown in FIG. 6. Thus the arms 15*a* and 16*a* of the bar define a slot whose shape is adapted to the cross-section of the doubly crimped flange shown in FIG. 5. It is seen in FIG. 6 that the crimping of arm 16*a* is onto the portion 13 of the flange which is deformed or crimped away from it—see the dashed lines. FIG. 6 shows in solid lines the edge of the flange between the opposite crimps 13, 14; in other words the crimps 14 of the flange are not seen on the right hand side of FIG. 6, but the arm 15*a* of the locking bar would be crimped onto the crimps 14 in the same way as arm 16*a* is crimped onto the crimp 13 (see deformed arm 15*b*).

It should also be noted that where low piling forces are required, or where high rigidity is not required, the locking bar may be bent into only some of the gaps between the crimps of the structural member.

A method and machine for crimping the flanges of the structural member are described in EP-A-0072118. To take the example of an I-beam, after its flanges are crimped in the known manner, a locking bar will in general be slotted on to each of the two flanges on one side, e.g. flanges 2*a* and 2*c* in FIG. 1, and then crimped. A machine for crimping the locking bars is illustrated in FIG. 7.

The machines comprises a G-clamp 10, a guide frame 11 and a hydraulic cylinder 12. As is clear from FIG. 7, the I-beam is positioned on its side, in the "H" orientation. The locking bar crimping press "floats" around the locking bar. When the hydraulic cylinder 12 is energised the G-clamp 10 moves downwards against the reaction of the guide frame 11. This causes the unsupported arm of the locking bar to collapse into the space between the crimps of the I-beam.

The left hand side of FIG. 7 shows the locking bar crimping machine in its floating position as it moves from one crimp to the next. The right hand side shows a locking bar crimp at the point of completion.

Of course, it is immaterial whether the locking bar crimping machine moves along the I-beam and locking bar, or whether the I-beam and locking bar are fed through the crimping machine. Furthermore, other conventional hydraulic ram machines could naturally be used to create the locking bar crimps.

The secondary crimping of the locking bars onto the I-beam, to form an integral unit, is in practice generally done on the production site, after the primary crimping of the I-beam. The secondary crimping thus replaces the welding operation of the prior art. The integral units formed after the secondary crimping are delivered to the construction site where they can be fitted together with other such units.

I claim:

1. A method of forming a structure comprising at least one locking bar and at least one structural member, at least one flange of the at least one structural member being formed with alternating first and second flange portions, at least the first flange portions being deformed out of the plane of the at least one flange, and the at least one locking bar having arms which between them define at least one slot configured to receive the at least one flange of the at least one structural member, wherein the method includes the step of deforming at least one arm of the at least one locking bar between the first and second flange portions.

2. The method according to claim 1, wherein the step of deforming further comprises deforming the arm of the at least one locking bar between said first flange portions.

3. The method according to claim 1 or 2, wherein the step of deforming further comprising fully deforming the at least one locking bar arm.

4. The method according to claim 3, wherein the locking bar arm is deformed between the said flange portions.

5. The method according to claim 4, wherein the deformed portions of the locking bar arm are forced into the surface of the flange.

6. The method according to claim 5, wherein both the first and second flange portions are deformed out of the plane of the flange, in opposing directions.

7. A method according to claim 6, wherein the opposing arms of the locking bar defining the slot are alternately deformed between the first flange portions or second flange portions respectively.

8. A piling structure comprising a plurality of locking bars and a plurality of structural members, at least one flange of each structural member being formed with alternating first and second flange portions, at least the first flange portions being formed out of the plane of the at least one flange, and each locking bar having arms which between them define at least one slot which receives the at least one flange of the structural members, wherein at least one arm of each locking bar is positioned between the first flange portions or on at least some of the first flange portions.

9. The piling structure according to claim 8, further comprising forming the first and second flange portions out of the plane of the at least one flange, in opposing directions.

* * * * *